US005500497A

United States Patent [19]

Merriman

[11] Patent Number: 5,500,497

[45] Date of Patent: Mar. 19, 1996

[54] RUBBER DOME/MYLAR SWITCH

[75] Inventor: Roger A. Merriman, Lakewood, Colo.

[73] Assignee: AT&T Corp., Murray Hill, N.J.

[21] Appl. No.: 356,859

[22] Filed: Dec. 15, 1994

Related U.S. Application Data

[63] Continuation of Ser. No. 164,115, Dec. 7, 1993, abandoned.

[51] Int. Cl.[6] ..... H01H 1/10

[52] U.S. Cl. ..... 200/512; 200/310; 200/317; 200/514

[58] Field of Search ..... 200/517, 512, 200/514, 314, 311, 312, 317, 513, 515, 516, 517, 308, 309, 310, 313

[56] References Cited

U.S. PATENT DOCUMENTS

| | | | |
|---|---|---|---|
| 4,056,701 | 11/1977 | Weber | 200/517 |
| 4,471,189 | 9/1984 | Bacon et al. | 200/512 |
| 4,580,018 | 4/1986 | Yoshihara | 200/517 |
| 5,138,119 | 8/1992 | Demeo | 200/512 |
| 5,403,984 | 4/1995 | Ogawa | 200/314 |

*Primary Examiner*—Henry J. Recla
*Assistant Examiner*—David J. Walczak

[57] ABSTRACT

A rubber dome switch assembly has a first contamination resistant sheet which overlies a circuit board upon which are switch footprints. The first sheet is apertured to expose the switch footprints and a second contamination resistant sheet overlies the first sheet and has switch closure pads on the underside thereof, each of which is adapted to bear against the corresponding switch footprint to close the switch. A third sheet is adapted to overlie the second sheet and has switch buttons formed thereon each adapted to bear against the second sheet to force the closure pad into contact with the corresponding switch footprint. A faceplate member overlies the third sheet. Pins are provided for aligning the several sheets, all of which are separable from each other, and bolts or spring clips are provided for clamping and holding the several elements together. To indicate switch button closure, an indicator such as a light-emitting diode, is associated with a respective switch button, and is aligned with a light pipe extending through the sheets, which is viewable through an aperture in the faceplate member. Alternatively, the indicator can be viewable through transparent portions of the first and second sheets, that are aligned with apertures in the third sheet and faceplate member.

15 Claims, 2 Drawing Sheets

RUBBER DOME/MYLAR SWITCH

This is a continuation of application Ser. No. 08/164,115 filed on Dec. 7, 1993, now abandoned.

FIELD OF INVENTION

This invention relates to rubber dome, pressure actuated switches and, more particularly, to such a switch that is substantially contamination free.

BACKGROUND OF THE INVENTION

Rubber dome pressure actuated switches are often used in field consoles and other telephone applications, most often over rigid circuit boards, especially where the use of hard plastic keys or hard plastic key caps are not practical, or where their incorporation into a push button type switch is not economically feasible. In addition, size and space restrictions often make the use of hard plastic caps unfeasible. It is often the case that sealants are used to impregnate the rubber dome, but the use of such materials and the process of impregnation are too costly, especially where the number of switches is extremely large, as in most telephone applications involving, for example, telephone consoles or terminals.

Heretofore, circuit board assemblies using rubber dome keys have been subject to mechanical and electrical failures in large numbers over an extended period of use, or where the use, i.e., actuation of the switch by an operator pressing on the dome, is of a high frequency of occurrence. Such failures are costly, especially in the field, both as to replacement of the defective switch and also as to repair of the switch or the circuit board itself. Thus, in prior art arrangements, any defects necessitating repair of the switch generally require replacement of the entire circuit board to which the switch is affixed.

Recent studies have shown that the circuit board containing the switch pads and upon which the switches are mounted and, more particularly, the switch pads themselves, are being contaminated during use by a foreign substance which chemical analysis has shown to be squalene, a salt that is expelled through the skin of the human body, most often as a component of sweat. Squalene is also found in some types of cosmetics and is thus quite prevalent. This substance or salt has an oily consistency and a very high viscosity which allows it to be readily absorbed by the silicone rubber of the domes. Over a period of time or of frequent operation, the rubber dome becomes saturated with the salt and, upon continued actuation of the switch, the salt becomes deposited on the circuit board, especially the switch pads, and almost invariably leads to failure of the switch pads or even of other components on the circuit board. One type of rubber dome switch that is susceptible to such contamination is shown in U.S. Pat. No. 4,818,829 of Nopper et al. In FIG. 2 of that patent, there is shown a structure wherein the dome, upon actuation, i.e., depression, bears against an active component of the circuitry on the circuit board. Over time, the squalene contamination will reach and probably contaminate this element.

In present usage, dome switches, or other types of pressure actuated switches, are made up of a plurality of parts which are generally bonded together for both stability and reliability. Such structures are shown in the aforementioned Nopper et al. patent as well as in U.S. Pat. No. 4,818,827 of Ipeinski, et al., which shows a bonded membrane type switch. As discussed heretofore, when contamination, deterioration, or other malfunction producing event occurs, the entire switch, as exemplified by the aforementioned patents, along with its companion circuit board, generally has to be replaced. It can be appreciated that, where, for example, fifty switches are mounted on the circuit board and only one switch causes a malfunction, such a replacement procedure can be extremely expensive. When, as in most of the prior art arrangements, a bonded type switch is used, there is no alternative to replacing the entire inseparable array of switches and other elements.

SUMMARY OF THE INVENTION

The present invention is a rubber dome switch arrangement that is substantially immune from the effects of contaminants, especially squalene, and that is so constructed that, when a malfunction does occur for whatever reason, the faulty portion of the switch can be readily and simply replaced in the field without the necessity of removing the entire switch array—circuit board assembly for replacement and repair. The switch of the invention does not require impregnation of the rubber dome with protective material, nor does it necessitate the use of hard plastic caps or hard plastic domes.

In a first illustrative embodiment of the invention, wherein the switch or array of switches is mounted on a base member such as a circuit board of a material such as glass epoxy and having a switch footprint thereon, the switch assembly comprises a first plastic sheet which overlies the circuit board with openings therein for components, such as light emitting diodes (LED), mounted on the circuit board, as well as for the carbon ink or gold plated switch footprint on the circuit board. Overlying the first plastic sheet and separable therefrom is a second, thinner sheet of plastic which likewise has openings therein for any LED's or other components intended to be visible or accessible from the top of the assembly, and a carbon pad on the underside in registry with the switch footprint on the circuit board. The material of both of the plastic sheets is preferably a polycarbonate such as Mylar® or a polyester film such as Melinix®, both of which are well known plastic material, formable into thin sheets, and which is virtually impervious to contaminants, liquids, or the like, and in general, is chemically inert with respect thereto.

Overlying the second sheet and separable therefrom is a rubber dome button sheet, preferably of a moderately flexible silicone rubber material, on which the actuating domes or buttons are formed. Where LED's are present, the rubber dome sheet also has openings therein for such components. Overlying the rubber dome sheet is a faceplate which has any necessary legends or graphics printed on the top surface thereof to guide the operator, and which is preferably formed from a rigid material such as aluminum or suitable plastic. The entire assembly is stacked, one element upon the other, and aligned so as to be in proper registry by means of rubber locating pins depending from the underside of the rubber dome sheet through locating holes in the mylar sheets and into locating holes in the circuit board. The locating pins are preferably formed integrally with the rubber dome sheet when it is molded. The assembly is preferably held together by means of screws or bolts which pass from the underside of the circuit board through the several elements and into threaded holes in the faceplate.

In a second illustrative embodiment of the invention, the faceplate is made with depending side walls, and, in the assembly of the switch and circuit board, the faceplate is inverted and the various elements as discussed in the foregoing, are stacked within the open box thus created. Locating pins mounted on or integral with the faceplate maintain the components in registry, with the pins terminating in holes in the circuit board. A closure plate is then snapped into place to hold the assembly together, and held in place by any suitable means, such as spring clips.

In both illustrative embodiments of the invention, the first plastic sheet overlies the circuit board circuitry and protects it from contamination, and the second sheet protects both the switch footprint and the switch pad from contamination from the rubber dome sheet. In addition, the various components of the switch are stacked together and held firmly in place and in proper registry so that disassembly of the switch and replacement of a faulty components can readily be accomplished in the field without the necessity of removing the entire assembly and sending it to a repair station.

DETAILED DESCRIPTION

Figure 1:
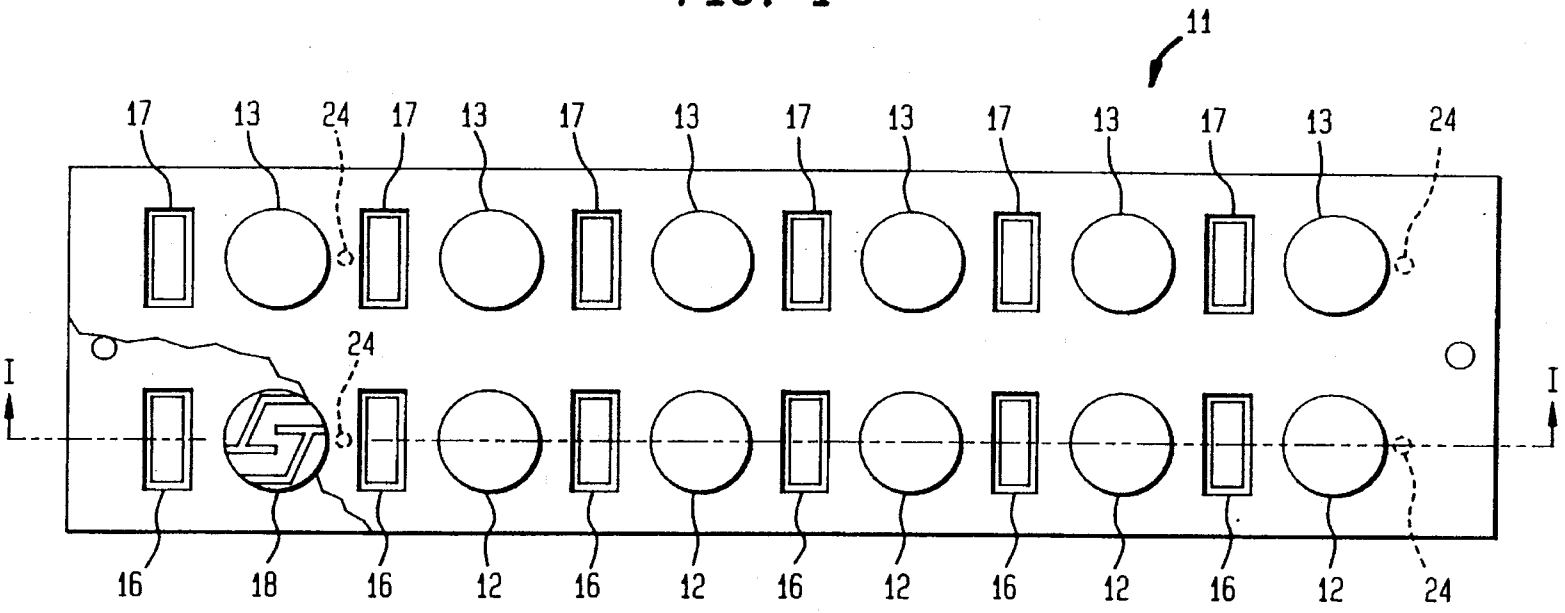
FIG. 1 is a plan view of s trip arrangement of dome switches which embody the principles of the present invention.
Figure 2:
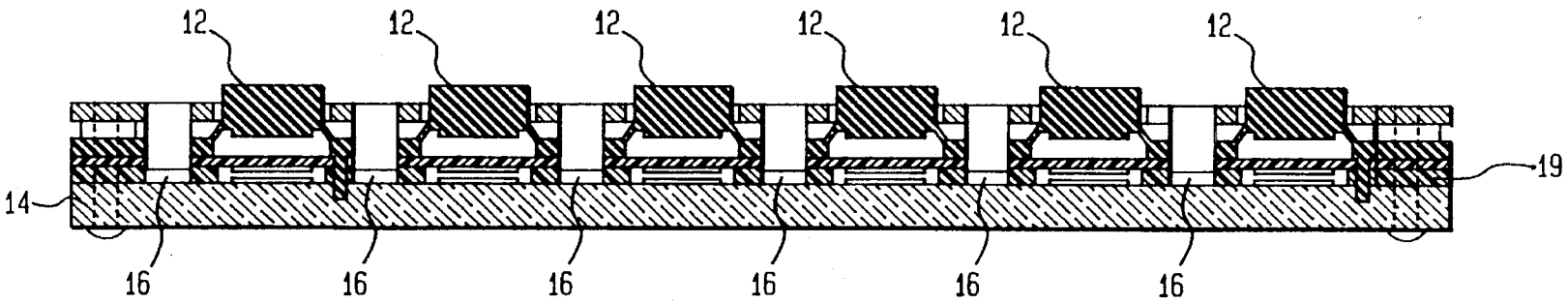
FIG. 2 is a sectional elevation view along the line I—I of FIG. 1.

In FIG. 1 there is shown a strip 11 of two banks of dome switches 12,12 and 13,13 as mounted on a circuit board 14, best seen in FIG. 2. It is to be understood that the configuration of strip 11 is for illustration purposes only, and that any configuration such as strips, square arrays, or other shapes may readily be used, the actual configuration being dictated by the circuit board arrangement in the particular functional application. Adjacent each of the switches 12,12 and 13,13 is a light emitting diode (LED) 16,16 and 17,17 for providing a suitable indication of the state of each switch and its associated circuitry. In actual practice, the LED's 16,16 and 17,17 are mounted on the circuit board 14 as part of the circuitry thereon. At the lower left hand corner of FIG. 1 a portion of the assembly 11 has been broken away to illustrate a switch footprint 18 which is mounted on circuit board 14 and forms part of the circuitry thereon.

Figure 3:
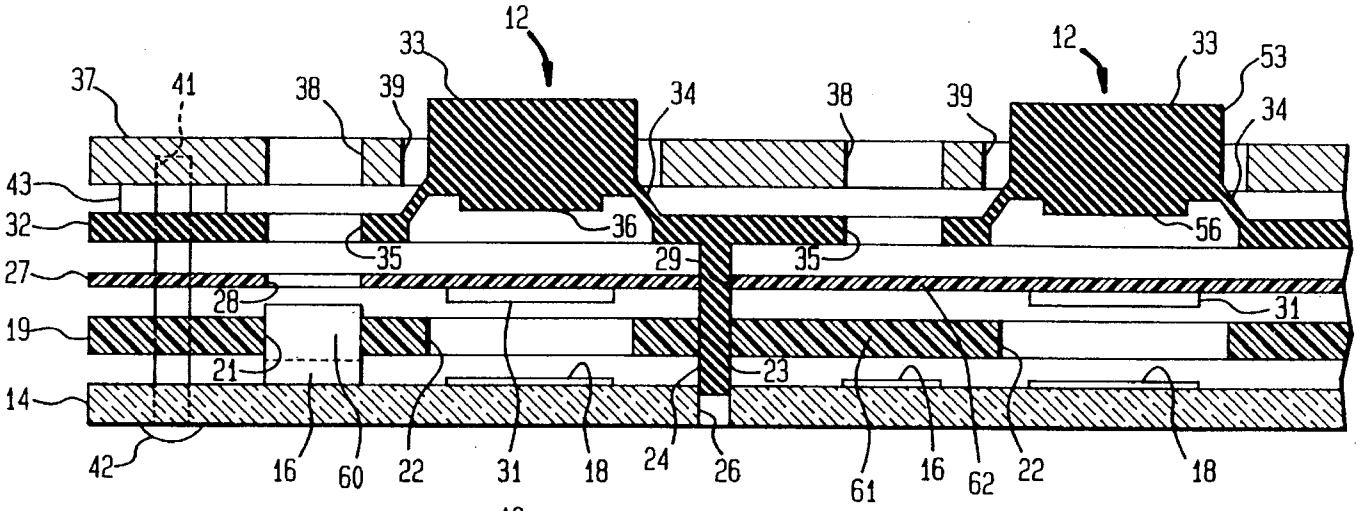
FIG. 3 is a partially exploded, sectional elevation view of an enlarged portion of FIG. 2.

With reference to FIGS. 2 and 3, it can be seen that the assembly 11 comprises, in this embodiment, the circuit board 14 of, for example, glass epoxy, upon which the circuitry, the LED's, 16,16 and 17,17, and the switch footprints 18 are mounted. Overlying the circuit board 14 is a first flexible sheet 19 of inert plastic material such as Mylar® or Melinex® which protects the circuitry on board 14 from contamination. It has been found that these materials are impervious to most contaminants likely to be encountered, more particularly, to squalene. As best seen in FIG. 3, sheet 19 has apertures 21,21 to permit passage of the LED's 16,16, therethrough. It is to be understood that LED's 16,16 may be much more compact than is shown in FIG. 3, being, for example, substantially flat or extending upward from board 14 only a very short distance, in which case a light pipe 60 (shown on the lefthand side of FIG. 3) could be mounted thereon as one possible alternative to transmit the light upward to the top of assembly 11 through an aperture 21. On the other hand, the light pipe 60 can be omitted (as indicated by the broke line in FIG. 3) in which case the LED's 16,16 can extend upward from board 14 for a considerable distance. Sheet 19 also has apertures 22,22 thereon to make switch footprints or pads 18,18 accessible to the actuating portions of the switch, as will be discussed hereinafter. Sheet 19 is also apertured at 23 to permit passage of a locating pin 24, also to be discussed more fully hereinafter. Board 14 also has apertures 26 therein to receive the locating pin 24.

Overlying sheet 19 is a switch closure sheet 27 of a suitable inert plastic material such as Mylar, which is also impervious to contaminants. Sheet 27 has apertures 28,28 therein to permit passage of LED's 16,16 or of their associated light pipes 60, and apertures 29 to permit passage of locating pins 24. On the underside of sheet 27, in registry with footprints 18,18, are carbon closure pads 31,31, which as will be apparent hereinafter, close each of the switches by shorting against the footprints 18,18 upon actuation. The thickness of sheet 19 is sufficient to maintain separation between the footprints 18 and the closure pads 31 to prevent accidental shorting, hence, closure of the individual switches. In practice, sheet 19 is approximately 0.005 inches thick. Sheet 27, on the other hand, is thin enough to provide sufficient resiliency and elasticity for closing and opening each switch. In practice, sheet 27 is approximately 0.003 inches thick. Although sheets 19 and 27 are shown as apertured for the LED's or light pipes 60 on the lefthand side of FIG. 3, in the case where the LED's are relatively flat, sheets 19 and 27 need not be apertured if they are transparent (which, in practice, they are) in which case the sheets 19 and 27 include portions 61, 62, respectively, aligned with the LED's as shown on the righthand side of FIG. 3. If the sheets 19 and 20 are transparent, an additional measure of protection is gained.

A rubber dome sheet 32 of a material such as silicone rubber overlies sheet 27 and has a plurality of actuating buttons 33,33 integrally formed thereon as by molding. Each button 33 is supported by a thin web 34 which provides the necessary elasticity to permit the button to be depressed to actuate the switch and, when the pressure by the operator is removed, to spring back to the position shown. The underside of each button 33 has a beating surface 36 which, when the button is depressed, bears against the top surface of sheet 27 and forces closure pad 31 down through aperture 22 into contact with footprint 18, thus closing the switch. As pointed out hereinbefore, when the actuating pressure is removed, button 33 and pad 31 spring back out of engagement as a result of the elasticity of web 34 and sheet 27. Depending from the underside of sheet 32 are a plurality of locating pins 24, only one of which is shown, which pass through the apertures in sheets 19 and 27 and into holes 26 in board 14. Pins 24, which are preferably, although not necessarily, formed integrally with sheet 32, function to align and maintain the sheets 19, 27 and 32 in proper registry with each other and with board 14. Sheet 32 also has apertures 35,35 for passage of LED 16 or a light pipe, or simply for viewing LED 16 from above.

A faceplate 37 overlies sheet 32, and has apertures 38,38 for viewing the LED's 16,16 17,17 and apertures 39,39 to permit buttons 33,33 to project above the surface thereof. Faceplate may be formed of any of a number of hard, rigid materials such as aluminum or plastic, and has whatever graphics or legends are necessary on the face thereof. Faceplate 37 has, on the underside thereof, threaded holes 41,41, only one of which is shown, into which are threaded bolts 42,42, only one of which is shown. Each bolt 42 passes through board 14 and sheets 19, 27 and 32 into hole 41 and, when tightened, pulls the parts into firm contact with each other, as seen in FIG. 2. A spacer member 43 serves to maintain a separation between faceplate 37 and the top of sheet 32 when the assembly is then clamped together. Although the switch assembly is shown as being clamped together by bolts 42, it is to be understood that other clamping means might readily be used.

As discussed hereinbefore, the switch of the invention as depicted in FIGS. 1, 2 and 3, is assembled by overlaying board 14 with sheet 19, sheet 19 with sheet 27, and sheet 27 with sheet 32, with faceplate 37 overlying, but separated, from sheet 32 and then by being clamped together. In the event that, for any reason, one of the components requires replacement, the switch assembly can be readily disassembled, the faulty part replaced, and the switch reassembled in the field without the necessity of removing and replacing the entire switch assembly. Thus, from both an operating and economic standpoint, the switch can, in effect, be repaired with a minimum of down time and at the cost of a single component as compared to the cost of a replacement switch.

Figure 4:
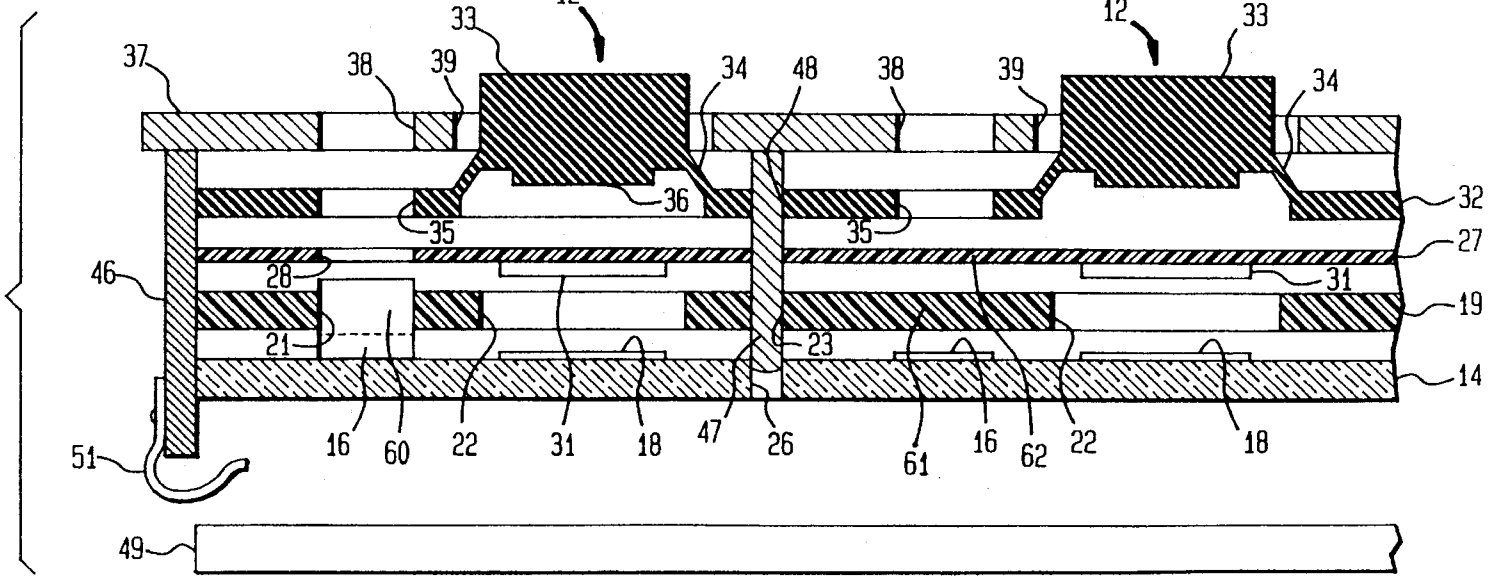
FIG. 4 is a partially exploded sectional view of a portion corresponding to that of FIG. 2 illustrating a second embodiment of the invention.

In FIG. 4 there is shown a second embodiment of the invention. For simplicity those components of the arrangement of FIG. 4 which are the same as those in the arrangement of FIG. 3 bear the same reference numerals.

In the arrangement shown in FIG. 4, faceplate 37 has depending side walls 46,46, only one of which is shown. Preferably each edge of plate 37 has a sidewall 46 depending therefrom which, in the case of a rectangular, square, or other shaped faceplate, form an open box. Mounted on the underside of faceplate 37, or integral therewith, are locating pins 47,47, only one of which is shown in FIG. 4. Rubber dome sheet 32 has apertures 48,48 therein through which pins. 47,47 pass in the assembled switch. In the assembly of the switch array and the circuit board 14, the open box is inverted so that faceplate 37 is at the bottom, and the component layers are then stacked within the box in proper sequence, commencing with rubber dome sheet 32, then sheet 27 and 19 and circuit board 14, with pins 47,47 passing through the corresponding apertures in the sheets and into holes 26,26 in circuit board 14. A plate or frame member 49 is then snapped into place against the underside of board 14 and held in place by suitable means such as springs 51. It is to be understood that springs 51,51 are only illustrative of any of a number of means for holding member 49 in place. Member 49 is so dimensioned that, when in place, it forces all of the layers into firm contact with adjacent layers, thereby insuring proper operation of the switch.

In both of the illustrative embodiments of the invention, disassembly and reassembly is both simple and quickly accomplished. Thus, as pointed out hereinbefore, individual components of the switch can be quickly replaced in the field, and the reassembled switch will be as contamination proof as the original assembly.

The foregoing embodiments of the invention are illustrative of the principles and features thereof. Numerous modifications may occur to workers in the art without departure from these principles or from the spirit and scope of the invention.

I claim:

1. A pressure actuated switch and circuit board assembly comprising, in combination, a base member having a first surface with a switch footprint thereon and one or more circuit components connected in circuit with said switch footprint;

a first sheet of contamination resistant flexible plastic non-conducting material overlying said base member and at least some of the circuit components thereon, said first sheet being apertured to expose said switch footprint, said first sheet being in contact with and separable from said base member;

a second sheet of contamination resistant flexible plastic non-conducting material overlying said first sheet in contact with said first sheet and separable therefrom, said second sheet having a switch pad on the surface thereof adjacent said first sheet in registry with said switch footprint;

a third sheet of an elastic material overlying said second sheet in contact with said second sheet and separable therefrom, said third sheet having formed thereon a pressure responsive switch actuation member, said switch actuation member having a bearing surface thereon adapted to bear against and depress said second sheet to move said switch pad into contact with said footprint upon application of pressure to said switch actuation member;

a faceplate member defining first and second apertures, and overlying said third sheet, the actuation member being aligned with the first aperture in said faceplate member;

means for aligning said first, second, and third sheets;

means for clamping and holding each of said first, second and third sheets in contact with adjacent sheets with said first sheet in contact with said first surface of said base member;

indicator means associated with said switch actuation member, for indicating contact of said switch footprint and said switch pad, said indicator means including a light-emitting diode; and viewing means communicating with said indicator means, for permitting viewing of said indicator means, said viewing means including a light pipe extending through said first, second and third sheets, the light pipe being aligned with the second aperture defined in said faceplate member.

2. A pressure actuated switch and circuit board assembly as claimed in claim 1, wherein said means for clamping and holding includes a spring clip means coupled to a side wall of said faceplate member, for holding said base member and said first, second and third sheets together by urging said base member and said first, second and third sheets toward said faceplate member.

3. A pressure actuated switch and circuit board assembly as claimed in claim 1, wherein said means for clamping and holding includes at least one bolt having a threaded end, the bolt extending through respective apertures defined in said first, second and third sheets, the threaded end of the bolt being threaded to corresponding threads of a third aperture defined in said faceplate member.

4. A pressure actuated switch and circuit board assembly as claimed in claim 1, wherein said means for aligning includes a locating pin integral with said third sheet, extending through apertures defined in said first and second sheets and said base member.

5. A pressure actuated switch and circuit board assembly as claimed in claim 1, wherein said means for aligning includes a pin extending from said faceplate member through apertures defined in said first, second and third sheets and said base member.

6. A pressure actuated switch and circuit board assembly comprising, in combination, a base member having a first surface with a switch footprint thereon and one or more circuit components connected in circuit with said switch footprint;

a first sheet of transparent contamination resistant flexible plastic non-conducting material overlying said base member and at least some of the circuit components thereon, said first sheet being apertured to expose said switch footprint, said first sheet being in contact with and separable from said base member;

a second sheet of transparent contamination resistant flexible plastic non-conducting material overlying said first sheet in contact with said first sheet and separable therefrom, said second sheet having a switch pad on the surface thereof adjacent said first sheet in registry with said switch footprint;

a third sheet of an elastic material overlying said second sheet in contact with said second sheet and separable therefrom, said third sheet having formed thereon a pressure responsive switch actuation member, said switch actuation member having a bearing surface thereon adapted to bear against and depress said second sheet to move said switch pad into contact with said footprint upon application of pressure to said switch actuation member;

a faceplate member defining first and second apertures, and overlying said third sheet, the actuation member being aligned with the first aperture in said faceplate member;

means for aligning said first, second, and third sheets;

means for clamping and holding each of said first, second and third sheets in contact with adjacent sheets with said first sheet in contact with said first surface of said base member;

indicator means associated with said switch actuation member, for indicating contact of said switch footprint and said switch pad, said indicator means including a light-emitting diode mounted on said base member; and viewing means communicating with said indicator means, for permitting viewing of said indicator means, said viewing means including portions of said first and second sheets, an aperture defined in said third sheet and the second aperture of said faceplate member, which are aligned with the light-emitting diode.

7. A pressure actuated switch and circuit board assembly as claimed in claim 6, wherein said means for clamping and holding includes a spring clip means coupled to a side wall of said faceplate member, for holding said base member and said first, second and third sheets together by urging said base member and said first, second and third sheets toward said faceplate member.

8. A pressure actuated switch and circuit board assembly as claimed in claim 6, wherein said means for clamping and holding includes at least one bolt having a threaded end, the bolt extending through respective apertures defined in said first, second and third sheets, the threaded end of the bolt being threaded to corresponding threads of an aperture defined in said faceplate member.

9. A pressure actuated switch and circuit board assembly as claimed in claim 6, wherein said means for aligning includes a locating pin integral with said third sheet, extending through apertures defined in said first and second sheets and said base member.

10. A pressure actuated switch and circuit board assembly as claimed in claim 6, wherein said means for aligning includes a pin extending from said faceplate member through apertures defined in said first, second and third sheets and said base member.

11. A pressure actuated switch and circuit board assembly comprising, in combination, a base member having a first surface with a switch footprint thereon and one or more circuit components connected in circuit with said switch footprint;

a first sheet of contamination resistant flexible plastic non-conducting material overlying said base member and at least some of the circuit components thereon, said first sheet being apertured to expose said switch footprint, said first sheet being in contact with and separable from said base member;

a second sheet of contamination resistant flexible plastic non-conducting material overlying said first sheet in contact with said first sheet and separable therefrom, said second sheet having a switch pad on the surface thereof adjacent said first sheet in registry with said switch footprint;

a third sheet of an elastic material overlying said second sheet in contact with said second sheet and separable therefrom, said third sheet having formed thereon a pressure responsive switch actuation member, said switch actuation member having a bearing surface thereon adapted to bear against and depress said second sheet to move said switch pad into contact with said footprint upon application of pressure to said switch actuation member;

a faceplate member defining first and second apertures, and overlying said third sheet, the actuation member being aligned with the first aperture in said faceplate member;

means for aligning said first, second, and third sheets;

means for clamping and holding each of said first, second and third sheets in contact with adjacent sheets with said first sheet in contact with said first surface of said base member;

indicator means associated with said switch actuation member, for indicating contact of said switch footprint and said switch pad, said indicator means including a light-emitting diode mounted on said base member; and viewing means communicating with said indicator means, for permitting viewing of said indicator means, said viewing means including apertures in the first, second and third sheets and the second aperture of the faceplate member, which are aligned with the light-emitting diode.

12. A pressure actuated switch and circuit board assembly as claimed in claim 6, wherein said means for clamping and holding includes a spring clip means coupled to a side wall of said faceplate member, for holding said base member and said first, second and third sheets together by urging said base member and said first, second and third sheets toward said faceplate member.

13. A pressure actuated switch and circuit board assembly as claimed in claim 11, wherein said means for clamping and holding includes at least one bolt having a threaded end, the bolt extending through respective apertures defined in said first, second and third sheets, the threaded end of the bolt being threaded to corresponding threads of an aperture defined in said faceplate member.

14. A pressure actuated switch and circuit board assembly as claimed in claim 11, wherein said means for aligning includes a locating pin integral with said third sheet, extending through apertures defined in said first and second sheets and said base member.

15. A pressure actuated switch and circuit board assembly as claimed in claim 11, wherein said means for aligning includes a pin extending from said faceplate member through apertures defined in said first, second and third sheets and said base member.

* * * * *